US008441509B2

(12) United States Patent
Matsuoka et al.

(10) Patent No.: US 8,441,509 B2
(45) Date of Patent: May 14, 2013

(54) IMAGE FORMING APPARATUS, IMAGE FORMING METHOD, AND PROGRAM

(75) Inventors: Jun Matsuoka, Kanagawa (JP); Ken Higuchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/220,220

(22) Filed: Aug. 29, 2011

(65) Prior Publication Data

US 2012/0056964 A1 Mar. 8, 2012

(30) Foreign Application Priority Data

Sep. 2, 2010 (JP) ..... P2010-196650

(51) Int. Cl.
*B41J 2/325* (2006.01)

(52) U.S. Cl.
USPC ..... 347/212

(58) Field of Classification Search ..... 347/171, 347/172, 174, 176, 212; 400/120.18, 120.04
See application file for complete search history.

(56) References Cited

U.S. PATENT DOCUMENTS

| | | | | |
|---|---|---|---|---|
| 8,149,255 | B2 * | 4/2012 | Higuchi et al. | 347/175 |
| 8,174,549 | B2 * | 5/2012 | Murakami | 347/175 |
| 2009/0035493 | A1 * | 2/2009 | Murakami et al. | 428/32.77 |

FOREIGN PATENT DOCUMENTS

JP 2009 248520 10/2009

* cited by examiner

*Primary Examiner* — Huan Tran
(74) *Attorney, Agent, or Firm* — Frommer Lawrence & Haug LLP; William S. Frommer

(57) ABSTRACT

An image forming apparatus includes: a transport unit that transports a recording medium; a thermal transfer sheet that has an ink layer, and a protective material layer thermally transferred onto the recording medium to form a protective layer; a reforming sheet that has a printing opening portion for causing the ink layer and the protective material layer to come into contact with a surface of the recording medium, and a surface property reforming portion for reforming surface properties of the protective layer; and a thermal head that heats and causes the surface property reforming portion to come into pressing contact with the recording medium through the thermally transferred protective material layer, wherein a temperature limitation area is set in an outer peripheral portion of an area where the surface properties are reformed, and heating of the surface property reforming portion in the temperature limitation area is restricted.

2 Claims, 11 Drawing Sheets

IMAGE FORMING APPARATUS, IMAGE FORMING METHOD, AND PROGRAM

BACKGROUND

The present disclosure relates to an image forming apparatus, an image forming method, and a program.

As thermal transfer printers, sublimation type, melt type, and thermal type printers have been mainly used. However, in the thermal transfer printers, there may be a case where due to minute unevenness on an image surface, the glossiness of the image is damaged. Therefore, in the related art, the image surface is flattened by heating and pressing a flat surface against the image surface, thereby enhancing the glossiness of the image.

For example, in Japanese Unexamined Patent Application Publication No. 2009-248520, an image forming method for enhancing the glossiness of an image using a thermal transfer sheet having an ink layer and a protective material layer, and a reforming sheet having a printing opening portion and a surface property reforming portion, is disclosed.

In this method, first, the reforming sheet is interposed between a recording medium and the thermal transfer sheet. Next, a printing layer (image) is formed by transferring the ink layer onto the recording medium via the printing opening portion, and a protective layer is formed onto the printing layer by transferring the protective material layer onto the recording medium. In addition, the thermal transfer sheet and the reforming sheet are aligned, and a flat surface of the surface property reforming portion is caused to come into pressing contact with the protective layer via a protective material layer area after the protective material layer is transferred (hereinafter, referred to as a transferred protective material layer) and heated, such that the surface properties of the protective layer are reformed.

SUMMARY

Here, in the surface property reforming process, it is preferable that heating and pressing are performed using the protective material layer in a transferred and uniform state. This is because when heating and pressing are performed using the protective material layer not in the transferred and uniform state, the protective material remaining on the protective material layer is adhered to the reforming sheet.

However, in practice, there may be a case where heating and pressing are performed using the protective material layer not in the transferred and uniform state due to errors in alignment between the thermal transfer sheet and the reforming sheet. In addition, when the protective material is adhered to the reforming sheet, thermal properties of the reforming sheet between an adhesion area and a non-adhesion area of the protective material may be changed, resulting in reforming defects of surface properties and peeling defects of the reforming sheet.

It is desirable to provide an image forming apparatus, an image forming method, and a program capable of suppressing adhesion of a protective material onto a reforming sheet due to positioning errors of a thermal transfer sheet.

According to an embodiment of the present disclosure, there is provided an image forming apparatus including: a transport unit that transports a recording medium in a predetermined direction; a thermal transfer sheet that has an ink layer thermally transferred onto the recording medium to form a printing layer, and a protective material layer thermally transferred onto the recording medium to form a protective layer; a transfer sheet travel unit that causes the thermal transfer sheet to travel; a reforming sheet that has a printing opening portion for causing the ink layer and the protective material layer to come into contact with a surface of the recording medium, and a surface property reforming portion for reforming surface properties of the protective layer; a reforming sheet travel unit that causes the reforming sheet to travel; and a thermal head that thermally transfers the ink layer and the protective material layer onto the recording medium, and causes the surface property reforming portion to come into pressing contact with the recording medium through the thermally transferred protective material layer and heats the surface property reforming portion, wherein a temperature limitation area is set in an outer peripheral portion of an area where the surface properties are reformed, and heating of the surface property reforming portion in the temperature limitation area is restricted by an upper limit capable of preventing adhesion of a protective material remaining in the protective material layer to the reforming sheet.

Heating of the surface property reforming portion in the temperature limitation area may be restricted by a lower limit capable of reforming the surface properties of the protective layer.

A buffer area that forms a boundary between the temperature limitation area and other areas may be set inside the temperature limitation area, and heating of the surface property reforming portion in the buffer area may be controlled to smooth out a difference in heating of the surface property reforming portion caused between the temperature limitation area and the other areas.

The temperature limitation area may be set to at least one side of the outer peripheral portion of the area where the surface properties are reformed.

The temperature control area may be set to four sides surrounding the outer peripheral portion of the area where the surface properties are reformed.

According to another embodiment of the present disclosure, there is provided an image forming method including: interposing a reforming sheet having a printing opening portion and a surface property reforming portion between a recording medium, and a thermal transfer sheet having an ink layer and a protective material layer; causing the recording medium, the thermal transfer sheet, and the reforming sheet to travel in a predetermined direction; aligning a printing position of the recording medium and the ink layer with the printing opening portion, and forming a printing layer by thermally transferring the ink layer onto the recording medium; aligning the printing position of the recording medium and the protective material layer with the printing opening portion, and forming a protective layer by thermally transferring the protective material layer onto the recording medium; and aligning the printing position of the recording medium and the protective material layer with the surface property reforming portion, and reforming surface properties of the protective layer by causing the surface property reforming portion to come into pressing contact with the recording medium through the thermally transferred protective material layer and heating the surface property reforming portion, wherein a temperature limitation area is set in an outer peripheral portion of an area where the surface properties are reformed, and heating of the surface property reforming portion in the temperature limitation area is restricted to be able to prevent adhesion of a protective material remaining in the protective material layer to the reforming sheet.

According to still another embodiment of the present disclosure, there is provided a program for executing the image forming method on a computer. Here, the program may be provided using a computer-readable recording medium or may be provided via a communication unit and the like.

As described above, according to the embodiments of the disclosure, an image forming apparatus, an image forming method, and a program capable of suppressing adhesion of a protective material onto a reforming sheet due to positioning errors of a thermal transfer sheet can be provided.

DETAILED DESCRIPTION OF EMBODIMENTS

Figure 1:
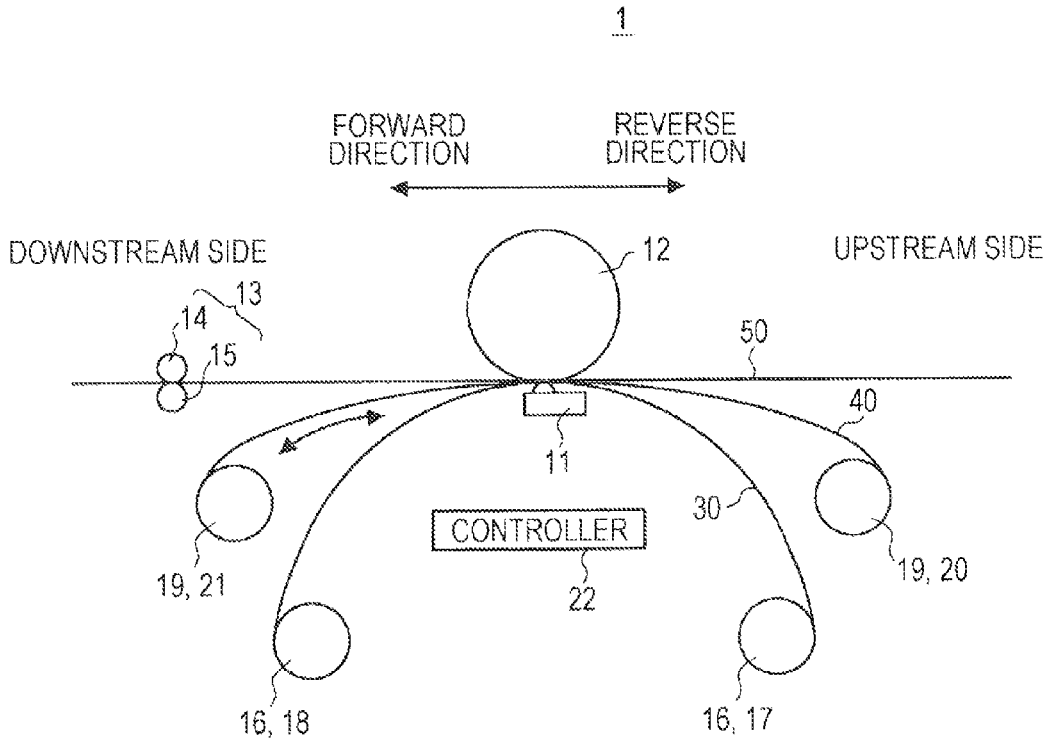
FIG. 1 is a diagram schematically showing the main configuration of an image forming apparatus.

Exemplary embodiments of the disclosure will now be described in detail with reference to the accompanying drawings. In the specification and the drawings, like elements which have substantially the same function are denoted by like reference numerals, and overlapping description will be omitted.

1. Configuration of Image Forming Apparatus 1

First, an example of an image forming apparatus 1 to which an embodiment of the disclosure is applied will be described with reference to FIGS. 1 to 7. Hereinafter, as the example of the image forming apparatus 1, a sublimation printer will be described. In FIG. 1, the main configuration of the image forming apparatus 1 is shown.

As shown in FIG. 1, the image forming apparatus 1 is provided with a thermal head 11, a recording medium 50, a thermal transfer sheet 30, and a reforming sheet 40. Hereinafter, the recording medium 50 is also referred to as a recording sheet 50, the thermal transfer sheet 30 is also referred to as an ink ribbon 30, and the reforming sheet 40 is also referred to as a reforming ribbon 40.

In the thermal head 11, a plurality of heat-generating elements (not shown) is arranged in lines. The plurality of heat-generating elements is selectively powered on depending on the gradation level of a printing image and generates heat energy used for transfer. The thermal head 11 transfers an ink layer 33 (ink dye) formed on the ink ribbon 30 onto the recording sheet 50 and forms a printing layer 51 (image) onto the recording sheet 50. In addition, the thermal head 11 transfers a protective material layer 35 (a protective material 36) formed on the ink ribbon 30 onto the recording sheet 50, and forms a protective layer 52 onto the printing layer 51 formed on the recording sheet 50.

The recording sheet 50 is installed at a predetermined position as roll paper and is transported if necessary. The recording sheet 50 is pinched by, for example, a transport unit 13 including a pinch roller 14 and a capstan 15, and is fed to upstream and downstream sides by forward and reverse rotation of the transport unit 13. The upstream side and the downstream side respectively mean a paper feed side and a paper discharge side of the recording sheet 50. The recording sheet 50 is drawn out by the transport unit 13 to pass between the thermal head 11 and a platen roller 12 for printing, and after image formation (formation of the printing layer 51 and the protective layer 52 and a surface property reforming process), is cut by a cutter C (see FIGS. 8 and 11) on the downstream side to be discharged.

The recording sheet 50 is not limited to the roll paper and may be non-roll paper such as a so-called cut paper. In this case, cutting of the recording sheet 50 becomes unnecessary; the cutter C may be omitted.

The ink ribbon 30 is fed by an ink ribbon travel unit 16 including a supply reel 17, a winding reel 18, and a plurality of guide rollers (not shown). The ink ribbon 30 is drawn out from the supply reel 17 and is guided by the guide rollers to pass between the thermal head 11 and the platen roller 12, and is sequentially wound around the winding reel 18.

The reforming ribbon 40 is disposed to be interposed between the recording sheet 50 and the ink ribbon 30. The reforming ribbon 40 is fed by a reforming ribbon travel unit 19 including a supply reel 20, a winding reel 21, and a plurality of guide rollers (not shown). The reforming ribbon 40 is drawn out from the supply reel 20 and is guided by the guide rollers to pass between the thermal head 11 and the platen roller 12 and is wound around the winding reel 21. The reforming ribbon 40 is able to be fed in two directions from the upstream side to the downstream side and from the downstream side to the upstream side.

In addition, the image forming apparatus 1 is provided with a controller 22 for controlling the operations of the image forming apparatus 1. The controller 22 is configured as hardware and/or software. The controller 22 includes a CPU, a ROM, a RAM, and the like, and the CPU develops and executes programs read from the ROM or the like on the RAM and may execute an image forming method related to the embodiment of the disclosure.

Figure 2:
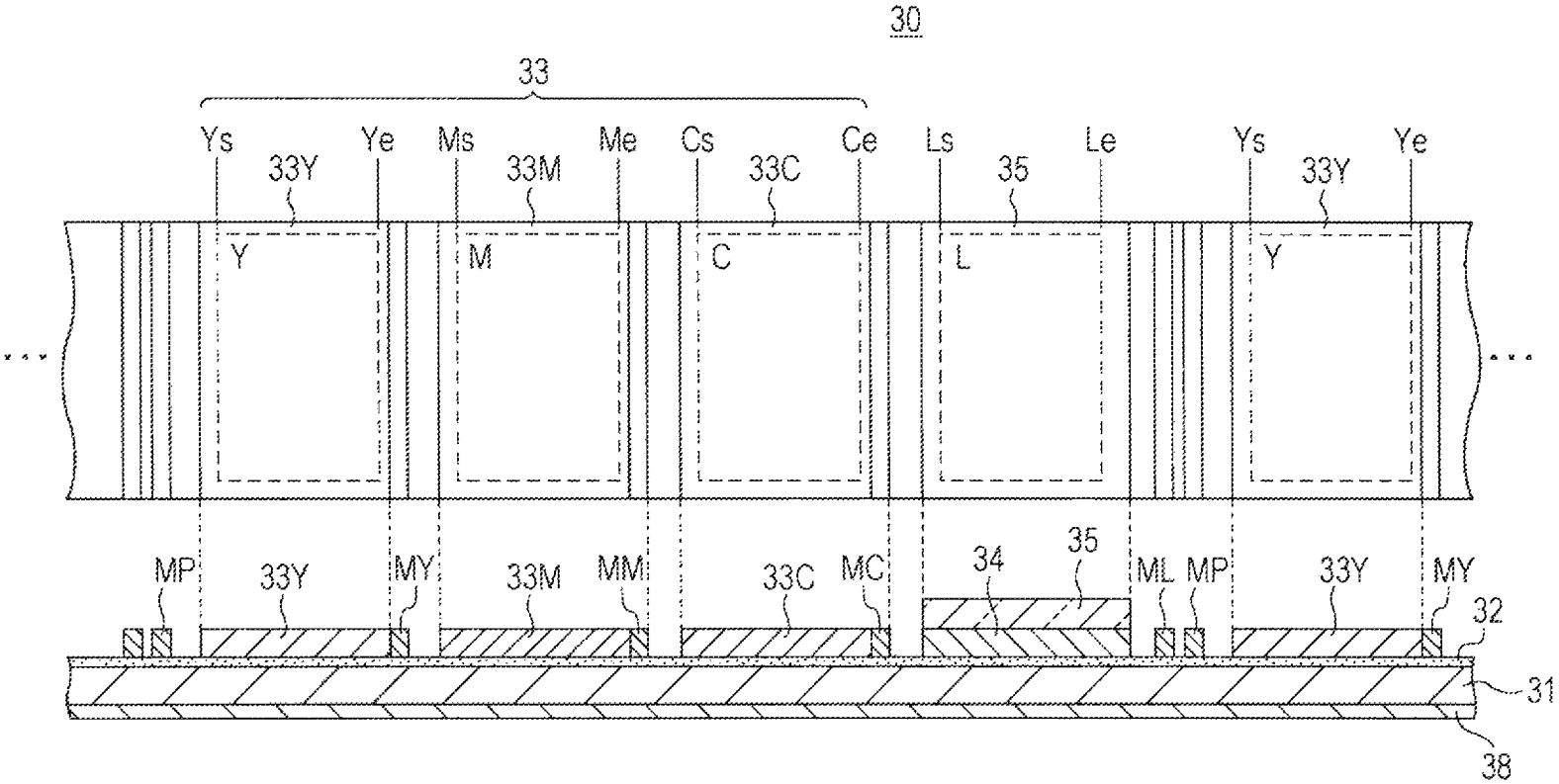
FIG. 2 is a diagram showing the configuration of an ink ribbon.

In FIG. 2, the configuration of the ink ribbon 30 is shown. As shown in FIG. 2, in the ink ribbon 30, an easily adhesive layer 32 is formed on one side of a base material 31. On the easily adhesive layer 32, ink layers 33Y, 33M, and 33C for yellow (Y), magenta (M), and cyan (C) are formed, and the transparent protective material layer 35 is formed with a peeling layer 34 interposed therebetween. The ink layers 33 (the general term for ink layers) and the protective material layer 35 are periodically formed in the order of the ink layers 33Y, 33M, and 33C and the protective material layer 35. The ink layer 33 is formed by applying a dye such as a sublimation die, and the protective material layer 35 is formed by applying the protective material 36 such as a transparent laminate resin.

The protective material layer 35 is transferred after the printing layer 51 is formed on the recording sheet 50 by the transfer of the ink layer 33, and forms the protective layer 52 for protecting the printing layer 51. The protective layer 52 enhances chemical resistance, solvent resistance, fat resistance, wear resistance, and the like of the printing layer 51. In addition, the protective layer 52 enhances glossiness and quality of images.

The protective material layer 35 is formed on the easily adhesive layer 32 with the peeling layer 34 interposed therebetween. Accordingly, during transfer of the protective material layer 35, peeling occurs at an interface between the peeling layer 34 and the protective material layer 35, and thus the peeling layer 34 remains on the ink ribbon 30 side, so that the protective material layer 35 (the protective material 36) is transferred onto the recording sheet 50. Therefore, transferability of the protective material layer 35 is enhanced.

On the other side of the base material 31, a heat resistant slipping layer 38 is formed. The heat resistant slipping layer 38 reduces friction between the thermal head 11 and the ink ribbon 30 and thus stabilizes travelling of the ink ribbon 30.

The ink layer 33 and the protective material layer 35 are formed as larger areas than an area actually transferred onto the recording sheet 50. The ink layer 33 and the protective material layer 35 are formed to surround the area that is actually transferred. In the ink layer 33 and the protective material layer 35, transfer starting positions and ending positions Ys and Ye, Ms and Me, Cs and Ce, and Ls and Le are set on starting end sides and ending end sides of the travel direction of the ink ribbon 30.

In the ink ribbon 30, markers M (the general term for markers) used for positioning the ink layers 33Y, 33M, and 33C and the protective material layer 35 are formed. The markers M include markers MY, MC, and MM representing the positions of the ink layer 33Y, 33M, and 33C and the protective material layer 35, and a marker MP representing the cycle of a combination of the ink layers 33Y, 33M, 33C, and the protective material layer 35.

Figure 3:
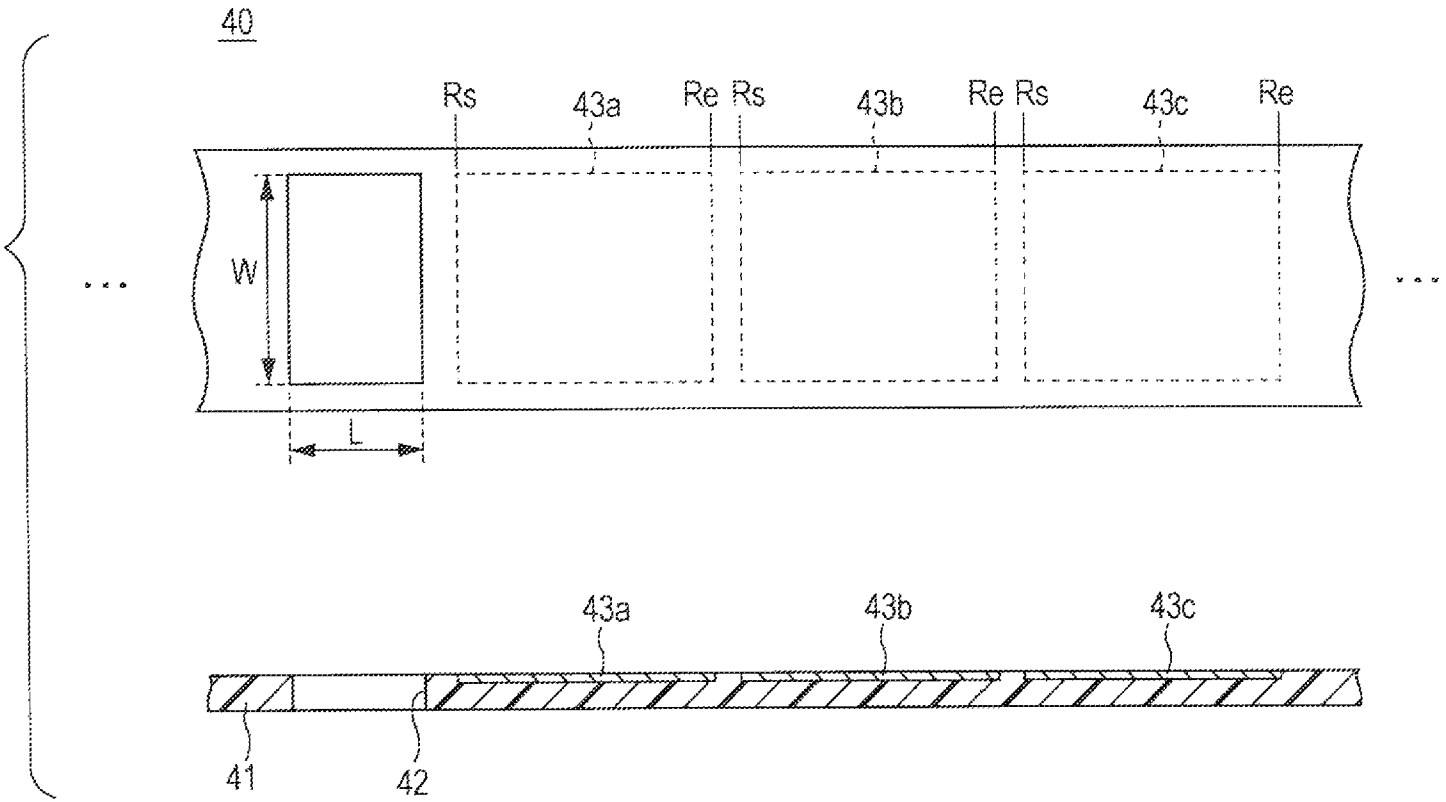
FIG. 3 is a diagram showing the configuration of a reforming ribbon.

In FIG. 3, the configuration of the reforming ribbon 40 is shown. As shown in FIG. 3, in the reforming ribbon 40, a printing opening portion 42 and surface property reforming portions 43 (the general term for surface property reforming portions) are formed on a base material 41 in line in the longitudinal direction. The base material 41 is formed of a resin material such as polyimide.

In the printing opening portion 42, an opening for causing the ink ribbon 30 to come into contact with the recording sheet 50 is formed. The printing opening portion 42 is formed to have a width W that is slightly greater than the length of the thermal head 11 in the main scanning direction.

In the surface property reforming portion 43, a reforming surface for reforming the surface property of the protective layer 52 formed on the recording sheet 50 is formed. The reforming surface is formed as a surface on the side that comes into pressing contact with the recording sheet 50 during a surface property reforming process. The reforming surface is formed as a mirror surface, a matt finish uneven surface, a silk finish uneven surface, or the like depending on the specifications of the surface properties of a final printout on which images are formed. In the surface property reforming portion 43, reforming starting position and ending position Rs and Re are set on the starting end side and the ending end side of the travel direction of the ink ribbon 30.

In FIG. 3, an example of a case where as the surface property reforming portions 43, a first surface property reforming portion 43*a* for a super-glossy surface, a second surface property reforming portion 43*b* for a matte tone surface, and a third surface property reforming portion 43*c* for a silk tone are formed is shown. However, the number and types of the surface property reforming portions 43 are not limited to this example.

On the base material 41, for example, the printing opening portion 42 and the surface property reforming portions 43*a*, 43*b*, and 43*c* are formed periodically. In addition, during formation of the printing layer 51 and the protective layer 52, the printing opening portion 42 is positioned at a position corresponding to the heat-generating elements of the thermal head 11, and during the surface property reforming process, the reforming ribbon 40 travels freely and appropriately so that the surface property reforming portion 43 is positioned at the position corresponding to the heat-generating elements. The reforming ribbon 40 can be repeatedly used.

2. Image Forming Process

Figure 4:
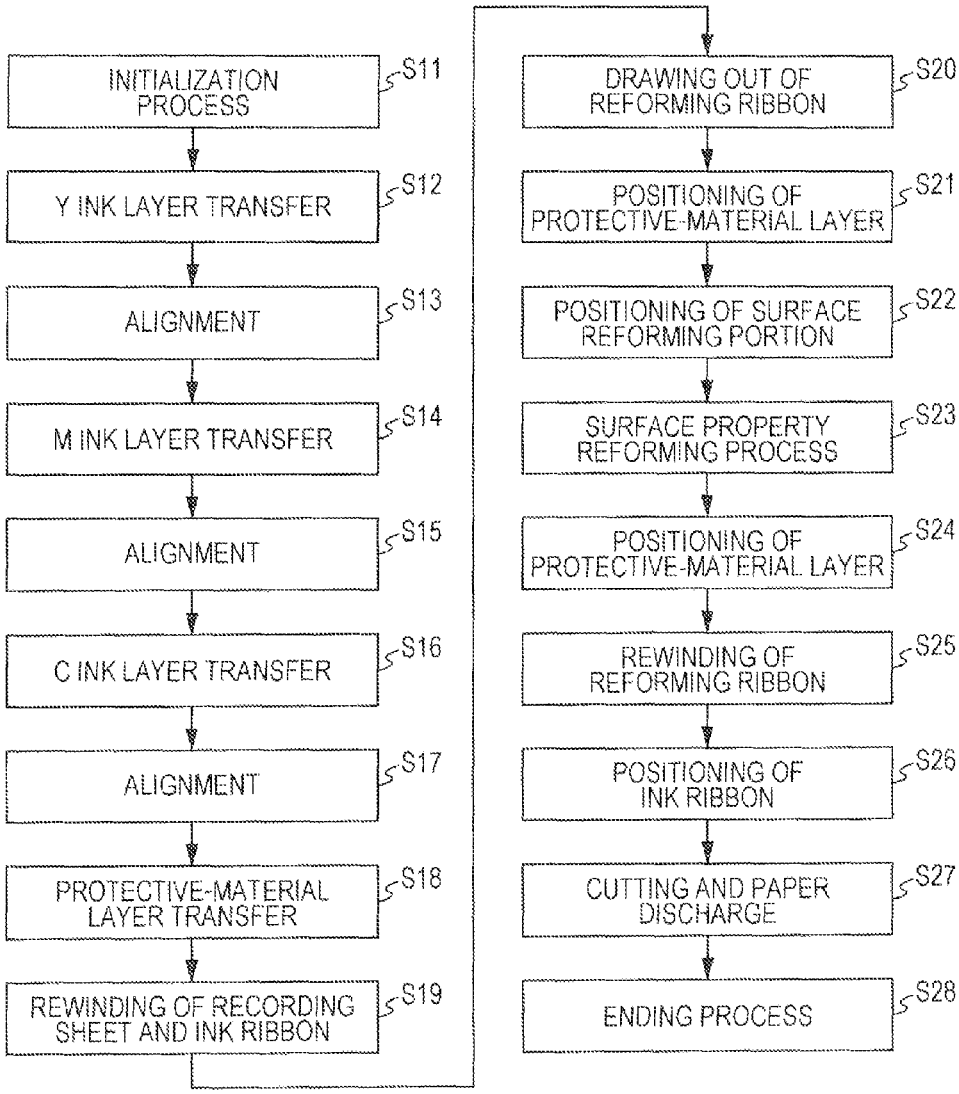
FIG. 4 is a flowchart showing the main steps of an image forming process.

In FIG. 4, the main steps of the image forming process are shown. As shown in FIG. 4, first, an initialization process (Step S11) necessary for the image forming process is performed. The initialization process includes alignment between the transfer staring position Ys of the ink layer 33Y and the printing starting position of the recording sheet 50. When alignment is completed, the ink layer 33Y is transferred onto the recording sheet 50 (Step S12). Similarly, alignment of the ink layer 33M, the ink layer 33C, and the protective material layer 35 is also performed by rewinding the recording sheet 50 and drawing out the ink ribbon 30 (Steps S13, S15, and S17), and transfer is performed (Steps S14, S16, and S18) after the alignment.

The glossiness of an image is enhanced by forming the protective layer 52 to some extent, however, a desired glossiness may not be necessarily obtained. This is because the surface of the protective layer 52 is formed as a peeling surface of the protective material layer 35 peeled off from the peeling layer 34 having insufficient flatness formed on the base material 31. Therefore, the surface property reforming process for reforming the surface properties of the protective layer 52 using the surface property reforming portion 43 having desired surface properties is performed.

When the formation of the printing layer 51 and the protective layer 52 is completed, the recording sheet 50 and the ink ribbon 30 are rewound (Step S19), and the reforming ribbon 40 is drawn out (Step S20). In addition, the transfer starting position Ls of the transferred protective material layer 37 (see FIG. 7) and the reforming starting position Rs of the surface property reforming portion 43 are positioned (Steps S21 and S22). When the positioning is completed, the protective layer 52 is heated while coming in pressing contact with the surface property reforming portion 43 via the transferred protective layer 37. Accordingly, the surface properties of the surface property reforming portion 43 are transferred onto the surface of the protective layer 52, such that the surface properties of the protective layer 52 are reformed (Step S23).

When the surface property reforming process is completed, the protective material layer 35 is positioned (Step S24), and the reforming ribbon 40 and the ink ribbon 30 are rewound (Steps S25 and S26). That is, the reforming ribbon 40 is rewound so that the printing opening portion 42 is disposed at the position corresponding to the heat-generating element, and the ink ribbon 30 is rewound so that an ink layer 33Y for the next cycle, which is not transferred yet, is disposed at the position corresponding to the heat-generating element. The recording sheet 50 is then cut and discharged (Step S27), and a predetermined ending process (Step S28) is performed.

Figure 5:
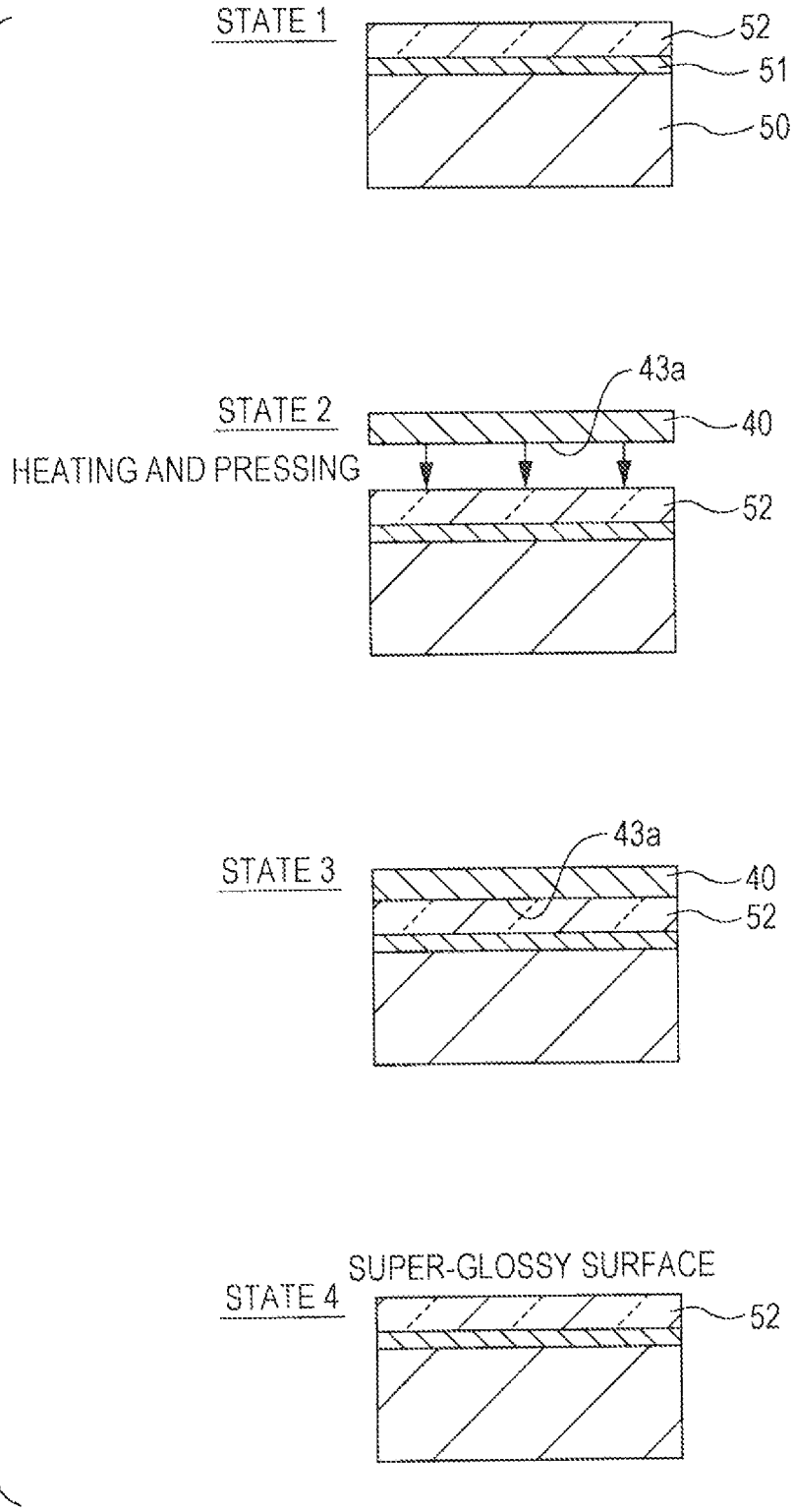
FIG. 5 is a cross-sectional view showing the main steps of the image forming process.

In FIG. 5, the main steps of the image forming process are shown. In FIG. 5, an example in which the surface of the protective layer 52 is reformed to a super-glossy surface using the surface property reforming portion 43 having a mirror surface as the reforming surface is shown.

First, as shown in State 1, the printing layer 51 is formed on the recording sheet 50 by the transfer of the ink layer 33, and furthermore the protective layer 52 is formed by the transfer of the protective material layer 35. Here, during the transfer of the ink layer 33 and the protective material layer 35, the ink layer 33 and the protective material layer 35 come into contact with the recording sheet 50 via the printing opening portion 42.

Next, before starting the reforming process, the ink ribbon 30 and the reforming ribbon 40 are aligned. Here, during the reforming process, the reforming surface of the surface property reforming portion 43 comes into contact with the recording sheet 50, and the transferred protective material layer 37 comes into contact with another surface of the surface property reforming portion 43. Therefore, the ink ribbon 30 and the reforming ribbon 40 are aligned so that the transfer starting position Ls (corresponding to the starting position of the transferred protective material layer 37) of the protective layer 52 and the reforming starting position Rs of the reforming process of the surface property reforming portion 43 are aligned with each other by the rotation of the ink ribbon travel unit 16 and the reforming ribbon travel unit 19 as precisely as possible.

Specifically, immediately after the formation of the protective material layer 35, on the ink ribbon 30, the transfer ending position Le of the protective material layer 35 corresponds to the position of the heat-generating element. In addition, on the reforming ribbon 40, the printing opening portion 42 corresponds to the position of the heat-generating element. Therefore, at the start of the reforming process, the ink ribbon 30 travels so that the transfer starting position Ls of the protective material layer 35 corresponds to the position of the heat-generating element. In addition, the reforming ribbon 40 travels so that the reforming starting position Rs of a predetermined surface property reforming portion 43 corresponds to the position of the heat-generating element.

When the alignment is completed, as shown in State 2, the reforming sheet 40 is caused to come into pressing contact with the recording sheet 50 and heated, thereby performing the reforming process. The reforming process is performed by simultaneously moving the recording sheet 50, the ink ribbon 30, and the reforming ribbon 40 in a state where the surface property reforming portion 43 is caused to come into pressing contact with the protective layer 52 by the thermal head 11 and the platen roller 12 and the protective layer 52 is heated by heat energy of the heat-generating element to about 70° C. to 120° C.

Then, as shown in State 3, the protective layer 52 reaches a temperature near the glass-transition temperature, and comes into close contact with the surface property reforming portion 43 while being slightly softened. Accordingly, the surface properties of the surface property reforming portion 43 are transferred onto the surface of the protective layer 52, such that the surface of the protective layer 52 is reformed to desired surface properties. In addition, as the protective layer 52 becomes distant from the thermal head 11, the temperature of an area subjected to the reforming process is reduced, and thus the reforming ribbon 40 is sequentially peeled off from the protective layer 52. As a result, as shown in State 4, the surface of the protective layer 52 is reformed to a super-glossy surface that is equal to a silver halide photograph.

Figure 6:
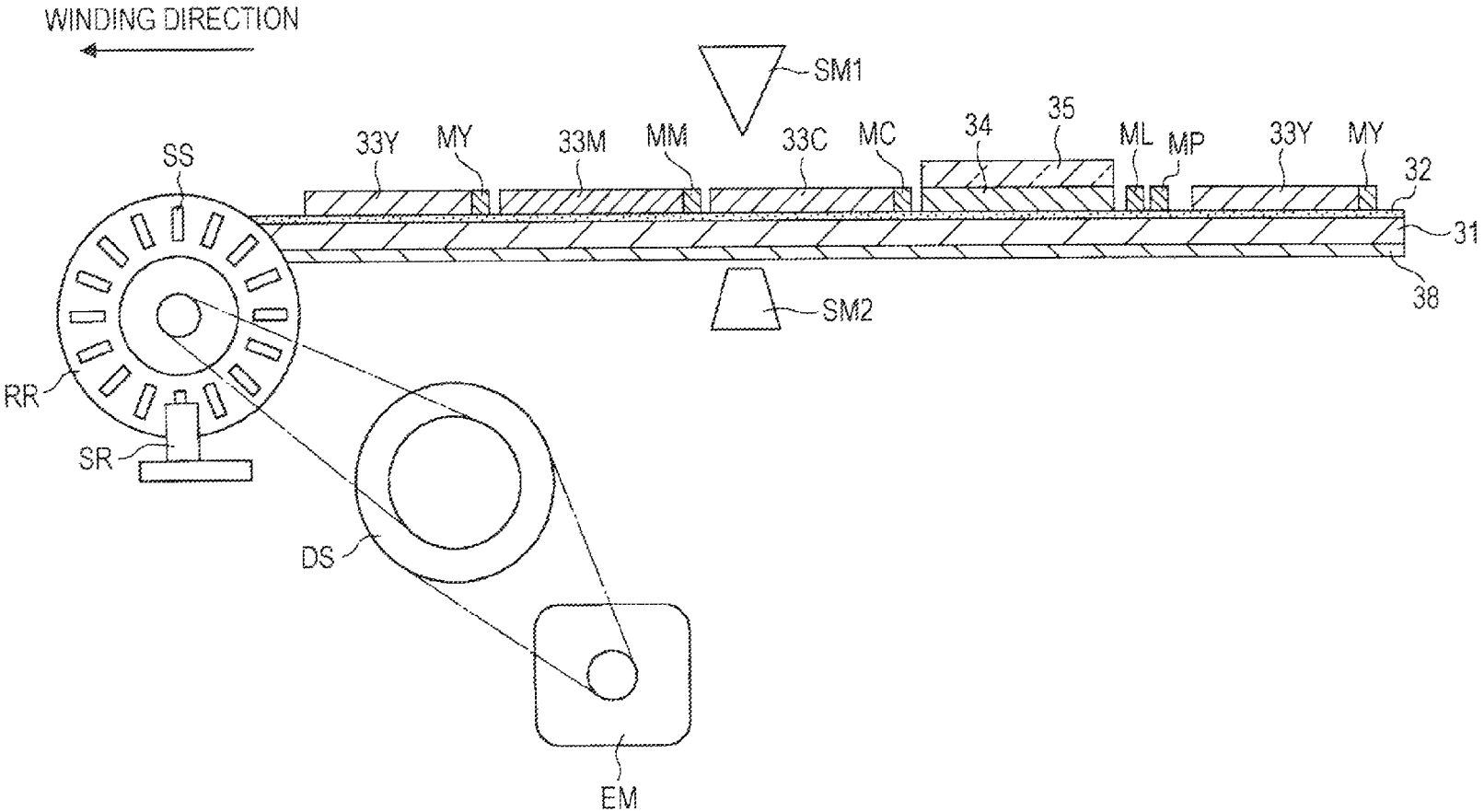
FIG. 6 is a diagram showing a positioning mechanism of the ink ribbon.

In FIG. 6, an example of a positioning mechanism of the ink ribbon 30 is shown. As shown in FIG. 6, the positioning mechanism includes marker sensors SM (SM1 and SM2) that detect the markers M on the ink ribbon 30, and a reel sensor SR that detects a rotation angle of a winding reel RR.

The marker sensors SM include a light-emitting portion SM1 such as an LED disposed on one side of the ink ribbon 30 in a travel path of the ink ribbon 30, and a light-receiving portion SM2 disposed on the other side thereof. The marker sensors SM detect the markers M by detecting a state where light emitted by the light-emitting portion SM1 is blocked by the markers M. A reel sensor SR detects a rotation angle of the reel RR by counting slits SS or the like formed on a rotation surface of the winding reel RR at predetermined intervals.

For example, when the protective material 35 is positioned, the winding reel RR is driven to rotate forward by a motor EM and a reel driving system DS until the marker ML of the protective material layer 35 is detected, and when the marker M is detected, driving of the motor EM is stopped. In addition, the winding reel RR is reversely driven by the motor EM and the reel driving system DS until a predetermined rotation angle is detected, and when the predetermined rotation angle is detected, driving of the motor EM is stopped. The predetermined rotation angle is set on the basis of the distance from the position of the marker M to the transfer starting position Ls of the protective material layer 35.

Therefore, during positioning of the ink ribbon 30, an error ΔE occurs due to detection precision of the marker sensors SM and the reel sensor SR, the resolution (the interval between the slits SS) of the reel sensor SR, the traceability of the reel driving system DS, and the like. In addition, there may be a case where the protective material 36 is adhered to the reforming ribbon 40 by the positioning error ΔE during the surface property reforming process.

Figure 7:
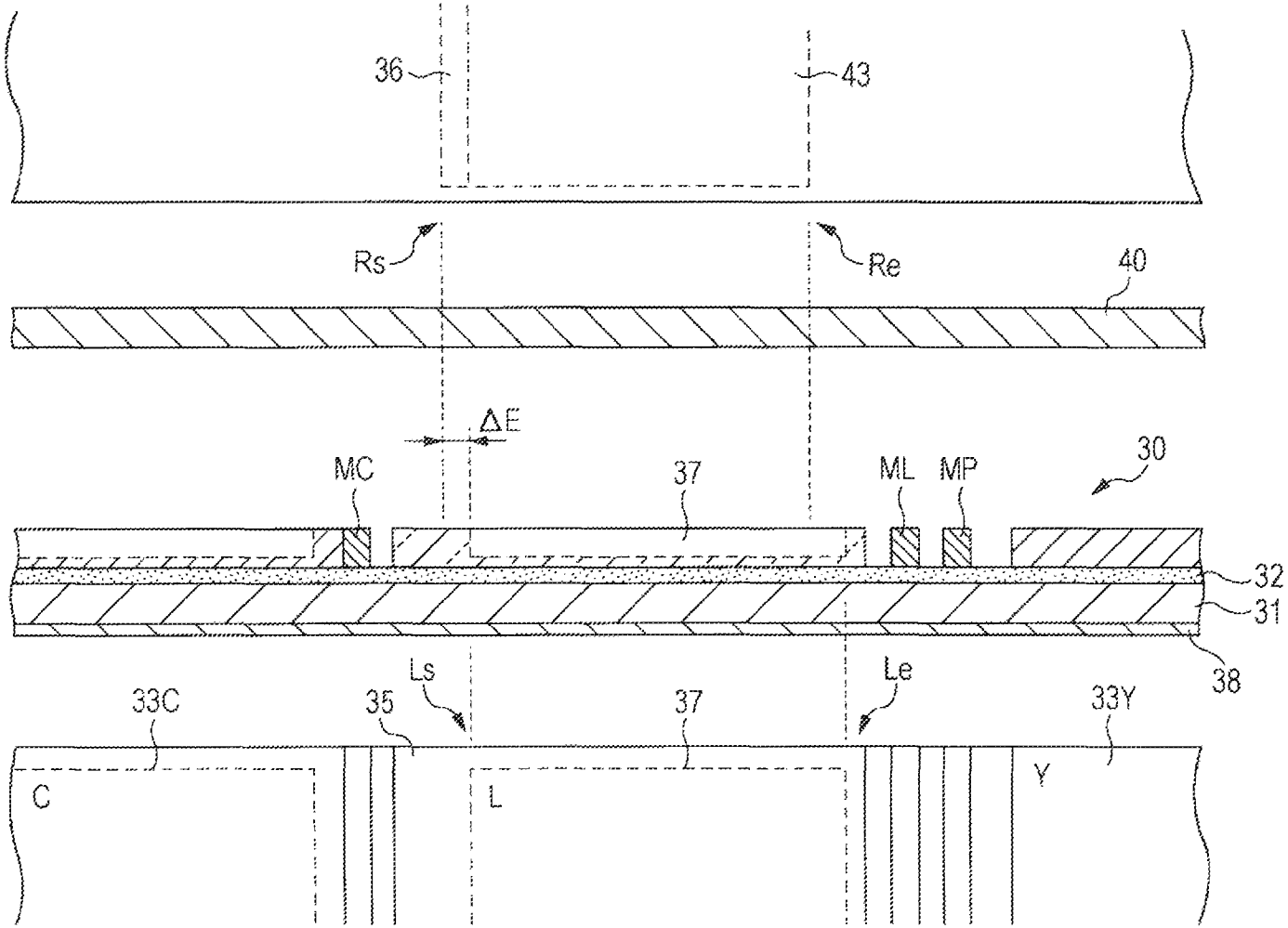
FIG. 7 is a diagram showing an adhered status of a protective material due to a positioning error.

FIG. 7 is a diagram showing an adhered status of the protective material 36 due to the positioning error ΔE. In FIG. 7, plan views and sectional views of the ink ribbon 30 and the reforming ribbon 40 are shown.

On the ink ribbon 30, the ink layers 33C and 33Y and the protective material layer 35 are shown. The ink layer 33C and the protective material layer 35 are in the transferred state onto the recording sheet 50, and the ink layer 33Y is not in the transferred state yet. In the protective material layer 35, the protective material 36 is peeled off from the protective material layer 35 by the transfer in a range from the transfer starting position Ls to the transfer ending position Le, however, the protective material 36 remains in the protective material layer 35 in other ranges.

The surface property reforming portion 43 transfers heat energy of the thermal head 11 to the protective layer 52 by coming into pressing contact with the recording sheet 50 via the transferred protective material layer 37. The surface property reforming portion 43 is caused to come into pressing contact over the range from the reforming starting position Rs to the reforming ending position Re. During the surface property reforming process, since heating and pressing are performed using the protective material layer 37 in the transferred and uniform state, the transfer starting position Ls of the protective material layer 35 and the reforming starting position Rs of the surface property reforming portion 43 are aligned with each other.

However, there may be a case where the reforming starting position Rs of the surface property reforming portion 43 is misaligned with the transfer starting position Ls of the protective material layer 35 due to the positioning error ΔE of the ink ribbon 30 described above. In FIG. 7, the reforming starting position Rs is positioned on the upstream side of the transfer starting position Ls. Therefore, on the upstream side of the travel direction of the ink ribbon 30, heating and pressing are performed through an area other than the transferred protective material layer 37, so that the protective material 36 remaining in the protective material layer 35 is adhered to the reforming ribbon 40.

Therefore, in the image forming method according to this embodiment of the disclosure, in order to prevent the adhesion of the protective material 36 to the reforming ribbon 40, heating of the reforming ribbon 40 in an outer peripheral portion AE of an area AR for reforming surface properties of the protective layer 52 (a surface property reforming area AR) is restricted. Here, the outer peripheral portion AE of the surface property reforming area AR means an area where there is a possibility that the protective material 36 remaining in the protective material layer 35 is adhered to the reforming ribbon 40 due to the positioning error ΔE of the ink ribbon 30. In addition, the outer peripheral portion AE of the surface property reforming area AR is distinguished from a central portion AC of the surface property reforming area AR, which is an area where there is no possibility that the protective material 36 is adhered.

3. First Embodiment

First, an image forming method according to a first embodiment of the disclosure will be described with reference to FIGS. 8 to 11. In the first embodiment, a temperature limitation area is set in the outer peripheral portion AE of the surface property reforming area AR.

Figure 8:
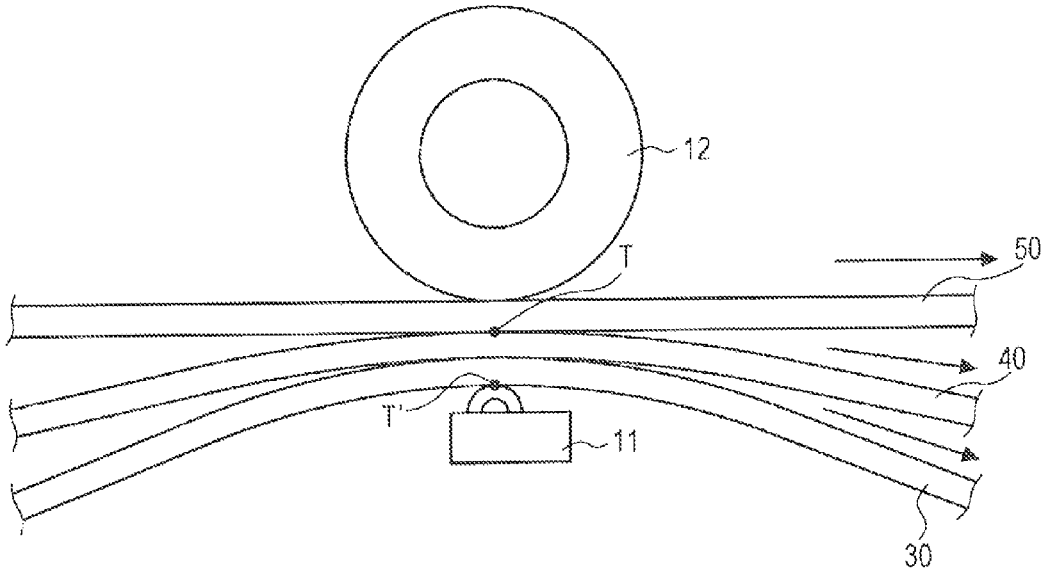
FIG. 8 is a diagram showing a heat transfer mechanism during a surface property reforming process.

In FIG. 8, a heat transfer mechanism during the surface property reforming process is shown. During the surface property reforming process, heat transfer from the thermal head 11 to the protective layer 52 on the recording sheet 50 occurs via the transferred protective material layer 37 on the ink ribbon 30 and the surface property reforming portion 43 on the reforming ribbon 40. In the thermal head 11, the plurality of heat-generating elements (not shown) is selectively powered on to generate a predetermined heat energy. In addition, the heat energy is transferred to the protective layer 52 via the protective material layer 35 and the surface property reforming portion 43 to heat the surface of the protective layer 52.

Here, in the thermal head, 11, the surface temperature thereof is controlled to a temperature T', however, in the surface property reforming portion 43, the surface temperature thereof is not controlled. Therefore, the surface temperature T of the surface property reforming portion 43 depends on a heat energy transfer condition defined by a transport speed of the recording sheet 50 and the like.

Figure 9:
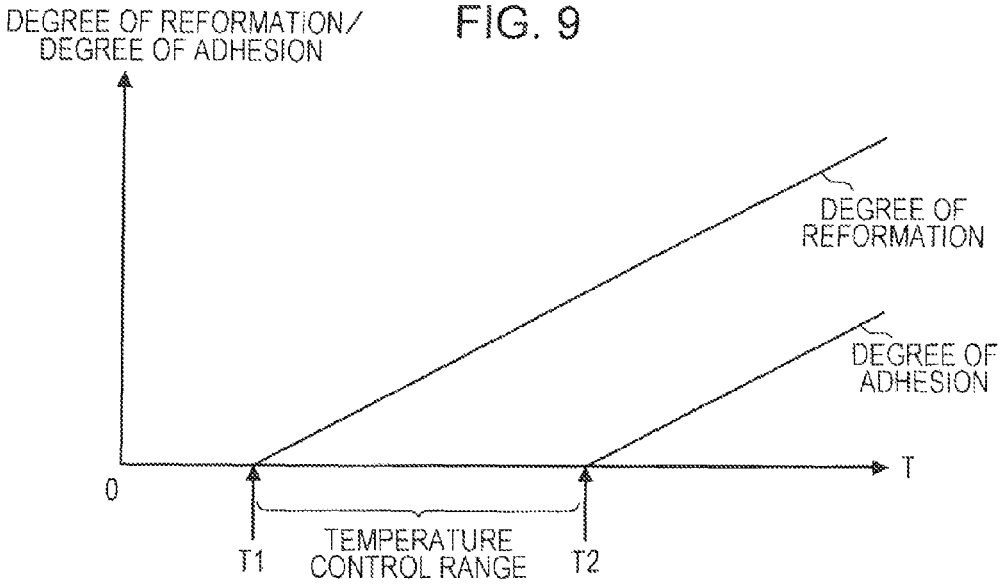
FIG. 9 is a diagram showing a temperature control range in a temperature limitation area.

In FIG. 9, a temperature control range in the temperature limitation area set to the outer peripheral portion AE of the surface property reforming area AR is shown. In FIG. 9, the horizontal axis represents the surface temperature T of the surface property reforming portion 43, and the vertical axis represents the degree of surface property reformation and the degree of adhesion of the protective material 36. The degree of surface property reformation is, for example, an index representing the glossiness of the surface of the protective layer 52, and the degree of adhesion of the protective material 36 is an index representing an amount of the protective material 36 adhered to the reforming ribbon 40.

As shown in FIG. 9, when the temperature of the surface property of the reforming portion 43 is equal to or higher than T1, the degree of surface property reformation is increased. However, when the temperature is lower than T1, the surface properties are not substantially reformed. Similarly, when the temperature of the protective layer 52 is equal to or higher than T2, the degree of adhesion of the protective material 36 is increased. However, when the temperature is lower than T2, the protective material 36 is not substantially adhered.

In the temperature limitation area, first, adhesion of the protective material 36 to the reforming ribbon 40 has to be prevented. Therefore, the upper limit of the temperature limitation range may be the maximum temperature capable of preventing the adhesion of the protective material 36 to the reforming ribbon 40. Moreover, the upper limit of the temperature limitation range is appropriately set depending on the material properties of the surface property reforming portion 43 or the protective material 36 and the like.

In the temperature control area, second, the surface properties of the protective layer 52 have to be reformed to some extent. Therefore, the lower limit of the temperature control range is set to the minimum temperature capable of reforming the surface properties of the protective layer 52 to some extent. However, since heating of the surface property reforming portion 43 is restricted, the surface properties of the protective layer 52 may not satisfy the degree of reformation for the central portion AC of the surface property reforming area AR.

Figure 10:
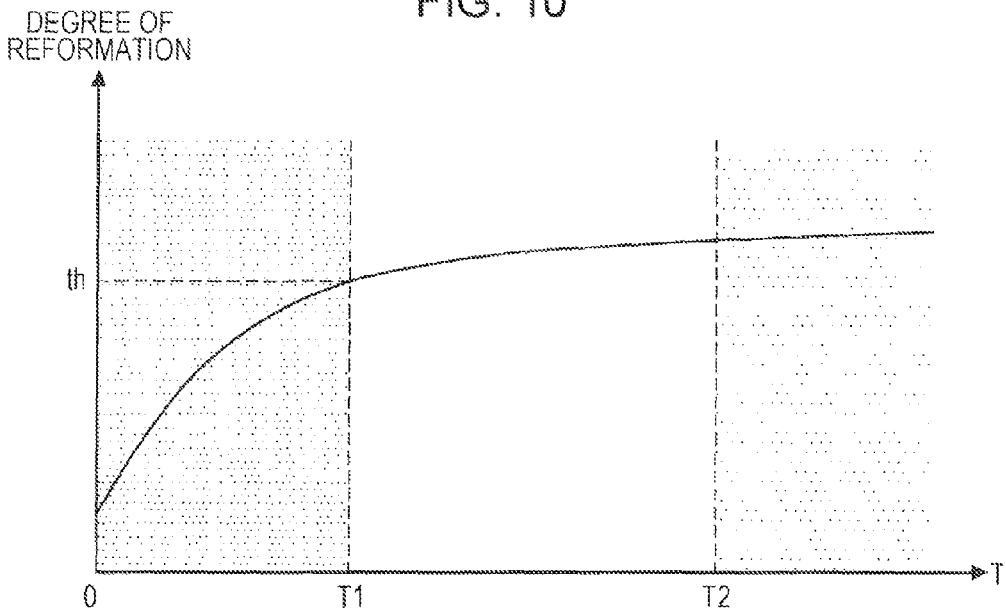
FIG. 10 is a diagram showing a setting status of the temperature control range.

In FIG. 10, a setting status of the temperature control range is shown. In FIG. 10, the horizontal axis represents the surface temperature T of the surface property reforming portion 43, and the vertical axis represents the degree of surface property reformation.

As shown in FIG. 10, the lower limit of the temperature control range is set to the minimum temperature T1 capable of reforming the surface properties of the protective layer 52 to a predetermined threshold th. In addition, the upper limit of the temperature control range is set to the maximum temperature T2 capable of preventing the adhesion of the protective material 36 to the reforming ribbon 40. That is, when the temperature of the surface property reforming portion 43 is lower than T1, the surface properties are not reformed, and when the temperature thereof is equal to or higher than T2, the protective material 36 is adhered. On the other hand, when the temperature of the surface property reforming portion 43 is equal to or higher than T1 and lower than T2, while preventing the adhesion of the protective material 36, the surface properties of the protective layer 52 can be reformed to some extent.

The lower limit T1 and the upper limit T2 of the temperature control range are set to T1=190 and T2=177 in a case where, for example, the setting value of a printing density by the thermal head 11 is set to a value of 0 to 255 (the maximum density of 0 and the minimum density of 255). Here, after a standard condition of transferring heat energy is assumed, the lower limit T1 and the upper limit T2 are set to the setting values of the printing density by the thermal head 11.

Figure 11:
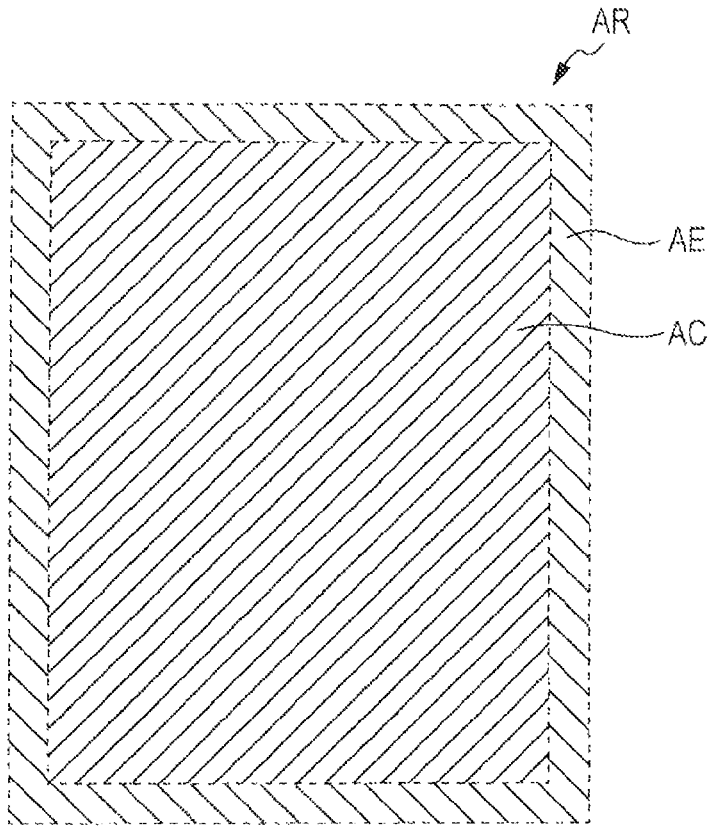
FIG. 11 is a diagram showing a setting example of the temperature limitation area related to a first embodiment.

In FIG. 11, a setting example of the temperature limitation area is shown. In the example shown in FIG. 11, the temperature limitation area is set to surround four sides of the surface property reforming area AR. In addition, the temperature limitation area may be set to an area in which the sides of the surface property reforming area AR have different widths. Otherwise, the temperature limitation area may not be the four sides of the surface property reforming area AR, and may be set to, for example, only sides perpendicular to the transport direction of the recording sheet 50 or set to only sides parallel to the transport direction.

For the temperature limitation area corresponding to the outer peripheral portion AE of the surface property reforming area AR, powering of the heat-generating elements is controlled by the controller 22 to satisfy the temperature control range shown in FIG. 10, thereby restricting heating of the surface property reforming portion 43. On the other hand, in the central portion AC (the area other than the temperature limitation area) of the surface property reforming area AR, regardless of the adhesion of the protective layer 52 to the reforming ribbon 40, powering of the heat-generating elements is controlled by the controller 22 in the temperature control range capable of reforming the surface properties of the protective layer 52 to a desired level.

4. Second Embodiment

Next, an image forming method according to a second embodiment of the disclosure will be described with reference to FIGS. 12 and 13. In the second embodiment, the temperature limitation area is set in the outer peripheral portion AE of the surface property reforming area AR, and a buffer area AB is set in the central portion AC of the surface property reforming area AR to be adjacent to the temperature control area.

In the first embodiment, since only the temperature limitation area is set in the outer peripheral portion AE of the surface property reforming area AR, a difference in the degree of surface property reformation between the outer peripheral portion AE (the temperature limitation area) of the surface property reforming area AR and the central portion AC (the area other than the temperature limitation area) thereof is increased. Therefore, there may be a case where a significant difference in quality of images occurs at the boundary between the outer peripheral portion AE and the central portion AC of the surface property reforming area AR.

Figure 12:
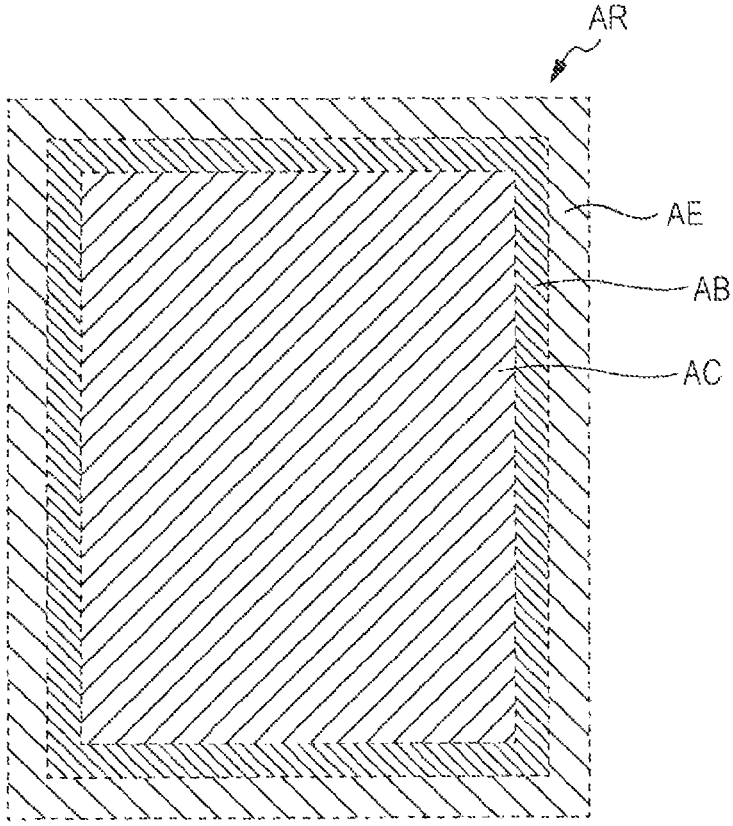
FIG. 12 is a diagram showing a setting example of a buffer area related to a second embodiment.

In FIG. 12, a setting example of the buffer area AB is shown. In the example shown in FIG. 12, the temperature limitation area is set in the outer peripheral portion AE of the surface property reforming area AR, and the buffer area AB is set in the central portion AC of the surface property reforming area AR to be adjacent to the temperature control area. In addition, the buffer area AB is set in the central portion AC of the surface property reforming area AR depending on the setting status of the temperature limitation area.

Figure 13:
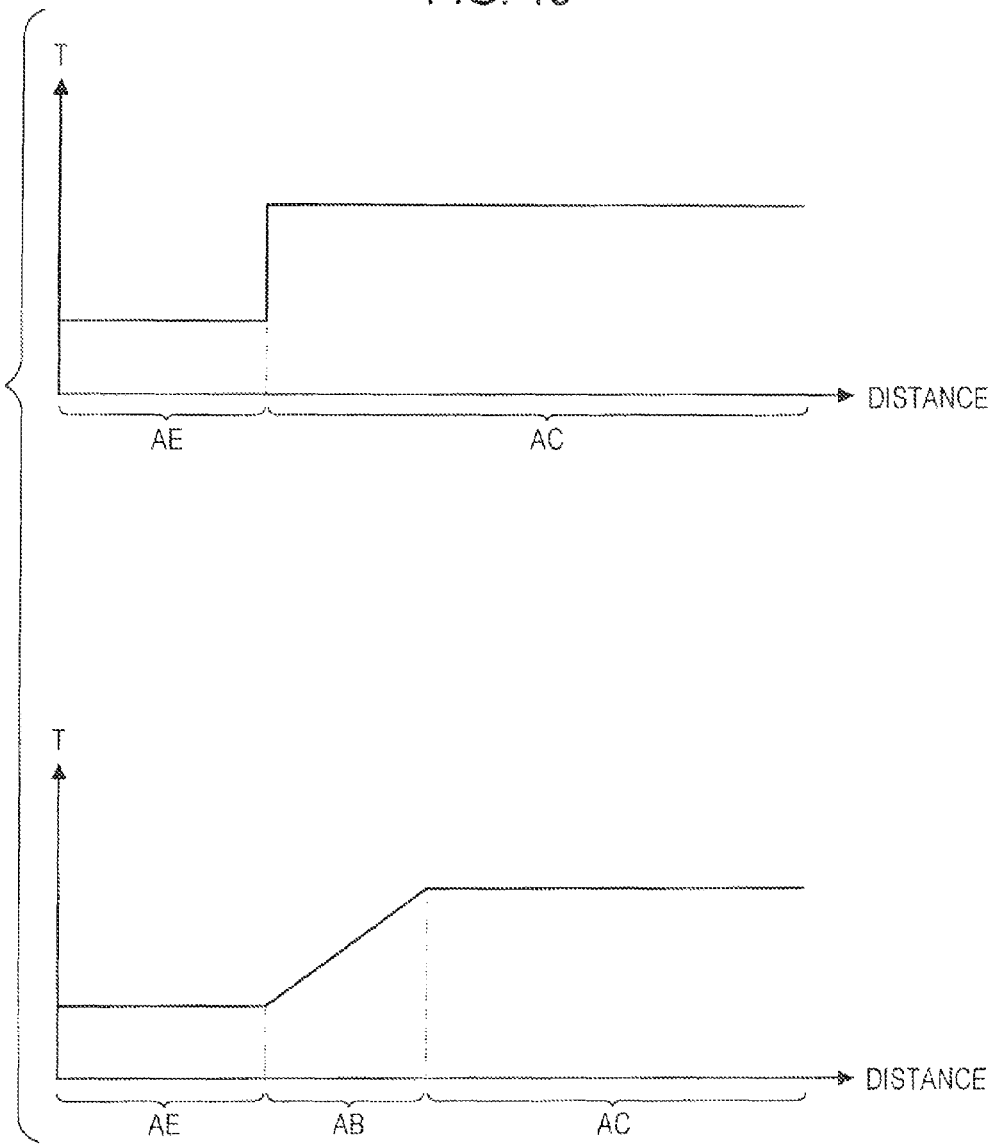
FIG. 13 is a diagram showing a temperature control example of the buffer area.

In FIG. 13, a temperature control example of the buffer area AB is shown. In FIG. 13, the horizontal axis represents the distance from the outer peripheral end of the surface property reforming area AR, and the vertical axis represents the surface temperature T of the surface property reforming portion 43.

In State 1 of FIG. 13, the buffer area AB is not set in the central portion AC of the surface property reforming area AR. Therefore, by restricting heating of the surface property reforming portion 43 in the temperature limitation area, a large difference in surface temperature occurs between the outer peripheral portion AE and the central portion AC of the surface property reforming area AR. Accordingly, there may be a case where a difference in the degree of surface property reformation is increased at the boundary between the outer peripheral portion AE and the central portion AC of the surface property reforming area AR, resulting in a significant difference in quality of images.

On the other hand, in State 2, the buffer area AB is set in the central portion AC of the surface property reforming area AR. Therefore, powering of the heat-generating elements can be controlled by the controller 22 so as to change the difference in surface temperature in stages using the buffer area AB. Here, powering of the heat-generating elements is controlled so that the heating temperature of the surface property reforming portion 43 is gradually increased from the outer peripheral portion AE of the surface property reforming area AR toward the central portion AC. Accordingly, the difference in the degree of surface property reformation is reduced at the boundary between the outer peripheral portion AE and the central portion AC of the surface property reforming area AR, thereby suppressing a significant difference in quality of images.

5. Conclusion

As described above, according to the image forming method related to the embodiments of the disclosure, heating of the surface property reforming portion 43 in the temperature limitation area set in the outer peripheral portion AE of the surface property reforming area AR is restricted by the upper limit T2 capable of preventing the adhesion of the protective material 36 remaining in the protective material layer 35 to the reforming ribbon 40. Accordingly, even though the positioning error ΔE of the ink ribbon 30 occurs, when the positioning error ΔE can be absorbed by the temperature limitation area, the adhesion of the protective material 36 to the reforming ribbon 40 can be prevented.

While the exemplary embodiments of the disclosure have been described in detail with reference to the accompanying drawings, they are not limited to the examples of the disclosure. It is apparently understood by those skilled in the art to which the disclosure belongs that various alternations and modifications can be made as they are within the spirit of the appended claims and thus naturally belong to the scope of the disclosure.

For example, in the foregoing description, the case where the disclosure is applied to the sublimation type printer is described. However, the disclosure can also be applied to thermal transfer printers such as melt type printers or thermal type printers.

The present application contains subject matter related to that disclosed in Japanese Priority Patent Application JP 2010-196650 filed in the Japan Patent Office on Sep. 2, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming method comprising:

interposing a reforming sheet having a printing opening portion and a surface property reforming portion between a recording medium, and a thermal transfer sheet having an ink layer and a protective material layer;

causing the recording medium, the thermal transfer sheet, and the reforming sheet to travel in a predetermined direction;

aligning a printing position of the recording medium and the ink layer with the printing opening portion, and forming a printing layer by thermally transferring the ink layer onto the recording medium;

aligning the printing position of the recording medium and the protective material layer with the printing opening portion, and forming a protective layer by thermally transferring the protective material layer onto the recording medium; and aligning the printing position of the recording medium and the protective material layer with the surface property reforming portion, and reforming surface properties of the protective layer by causing the surface property reforming portion to come into pressing contact with the recording medium through the thermally transferred protective material layer and heating the surface property reforming portion, wherein a temperature limitation area is set in an outer peripheral portion of an area where the surface properties are reformed, and heating of the surface property reforming portion in the temperature limitation area is restricted to be able to prevent adhesion of a protective material remaining in the protective material layer to the reforming sheet.

2. A non-transitory computer-readable recording medium for storing a computer program that when executed on a computer causes image forming processing, the program comprising the steps of:

interposing a reforming sheet having a printing opening portion and a surface property reforming portion between a recording medium, and a thermal transfer sheet having an ink layer and a protective material layer;

causing the recording medium, the thermal transfer sheet, and the reforming sheet to travel in a predetermined direction;

aligning a printing position of the recording medium and the ink layer with the printing opening portion, and forming a printing layer by thermally transferring the ink layer onto the recording medium;

aligning the printing position of the recording medium and the protective material layer with the printing opening portion, and forming a protective layer by thermally transferring the protective material layer onto the recording medium; and aligning the printing position of the recording medium and the protective material layer with the surface property reforming portion, and reforming surface properties of the protective layer by causing the surface property reforming portion to come into pressing contact with the recording medium through the thermally transferred protective material layer and heating the surface property reforming portion, wherein a temperature limitation area is set in an outer peripheral portion of an area where the surface properties are reformed, and heating of the surface property reforming portion in the temperature limitation area is restricted to be able to prevent adhesion of a protective material remaining in the protective material layer to the reforming sheet.

* * * * *